US007673600B2

(12) United States Patent
Yang

(10) Patent No.: US 7,673,600 B2
(45) Date of Patent: Mar. 9, 2010

(54) METHOD AND SYSTEM FOR PARTIAL CYCLE BLEEDER BRAKE

(75) Inventor: Zhou Yang, Oak Ridge, NC (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 96 days.

(21) Appl. No.: 11/400,273

(22) Filed: Apr. 10, 2006

(65) Prior Publication Data

US 2007/0144472 A1 Jun. 28, 2007

Related U.S. Application Data

(60) Provisional application No. 60/754,208, filed on Dec. 28, 2005.

(51) Int. Cl.
*F01L 1/34* (2006.01)

(52) U.S. Cl. ..... 123/90.16; 123/90.15

(58) Field of Classification Search ..... 123/90.16, 123/90.15

See application file for complete search history.

(56) References Cited

U.S. PATENT DOCUMENTS

| | | | | |
|---|---|---|---|---|
| 4,887,562 | A | 12/1989 | Wakeman | |
| 4,930,465 | A | 6/1990 | Wakeman et al. | |
| 5,531,192 | A | 7/1996 | Feucht et al. | |
| 5,680,841 | A * | 10/1997 | Hu | 123/322 |
| 5,996,550 | A | 12/1999 | Israel et al. | |
| 6,085,705 | A | 7/2000 | Vorih | |
| 6,415,752 | B1 | 7/2002 | Janak | |
| 6,477,997 | B1 | 11/2002 | Wakeman | |
| 6,594,996 | B2 * | 7/2003 | Yang | 60/602 |
| 6,883,492 | B2 | 4/2005 | Vanderpoel et al. | |
| 7,013,867 | B2 * | 3/2006 | Rammer et al. | 123/321 |
| 2005/0211206 | A1 * | 9/2005 | Ruggiero et al. | 123/90.16 |

* cited by examiner

*Primary Examiner*—Zelalem Eshete
(74) *Attorney, Agent, or Firm*—Kelley Drye & Warren, LLP

(57) ABSTRACT

Systems and methods for providing partial bleeder braking engine valve actuation are disclosed. In an embodiment of the present invention, a cam may be provided with a main exhaust lobe, a partial bleeder lobe and an inner base circle portion between the two lobes. A rocker arm including an internal rocker passage may be operatively connected to the cam. The rocker arm may contact a valve bridge at a central portion. The valve bridge may be operatively connected to first and second engine valves at its first and second ends, respectively. A slave piston incorporated into the first end of the valve bridge and a master piston may be incorporated into the central portion of the valve bridge. A hydraulic circuit may be provided between the master and slave pistons. A bleed hole may be provided above the slave piston. The master and slave pistons may be selectively actuated and the bleed hole may be selectively blocked and unblocked to provide partial bleeder braking as a result of the valve actuation motion imparted from the cam to the valve bridge through the rocker arm.

24 Claims, 2 Drawing Sheets

METHOD AND SYSTEM FOR PARTIAL CYCLE BLEEDER BRAKE

CROSS REFERENCE TO RELATED APPLICATIONS

This application relates to and claims the priority of U.S. provisional patent application Ser. No. 60/754,208 which was filed Dec. 28, 2005.

FIELD OF THE INVENTION

The present invention relates systems for, and methods of producing engine braking events in an internal combustion engine. In particular, the present invention relates to engine braking systems and methods for producing bleeder, including partial-cycle bleeder, engine braking valve events.

BACKGROUND OF THE INVENTION

Flow control of exhaust gas through an internal combustion engine has been used in order to provide vehicle engine braking. Generally, engine braking systems may control the flow of exhaust gas from the engine cylinders to the exhaust system (i.e., exhaust manifold, tail pipe, etc.). The flow of exhaust gas from the engine cylinders may be controlled to provide a retarding force on the engine pistons to slow the engine. Specifically, one or more exhaust valves may be selectively actuated to provide compression-release, bleeder, and/or partial bleeder engine braking.

The operation of a compression-release type engine brake, or retarder, is well known. A four-stroke internal combustion engine experiences intake, compression, expansion, and exhaust cycles during its operation. The intake cycle occurs in conjunction with a main intake valve event, during which the intake valves in each cylinder are opened to allow air to enter the cylinder. The exhaust cycle occurs in conjunction with a main exhaust valve event, during which the exhaust valves in each cylinder are opened to allow combustion gases to exit the cylinder. Typically, the exhaust and intake valves are closed during much of the compression and expansion cycles. During compression-release engine braking, fuel supply to the engine cylinders is ceased and, in addition to the main exhaust valve event, one or more exhaust valves also may be selectively opened during the compression stroke to convert the internal combustion engine into a power absorbing air compressor. Specifically, as an engine piston travels upward during the compression stroke, the gases trapped in the cylinder are compressed and oppose the upward motion of the piston. As the piston approaches the top dead center (TDC) position during the compression stroke at least one exhaust valve may be opened to release the compressed gases in the cylinder to the exhaust manifold, preventing the energy stored in the compressed gases from being returned to the piston on the subsequent expansion down-stroke. In doing so, the engine develops retarding power to help slow the vehicle down. An example of a prior art compression release engine brake is provided by the disclosure of Cummins, U.S. Pat. No. 3,220,392 (November 1965), which is hereby incorporated by reference.

The operation of a bleeder type engine brake is also known. During bleeder engine braking, in addition to the main exhaust valve event, one or more exhaust valve(s) may be held slightly open throughout the remaining engine cycles (i.e., the intake, compression, and expansion cycles for a full-cycle bleeder brake) or during a portion of the remaining engine cycles (i.e., the compression and expansion cycles for a partial-cycle bleeder brake). The primary difference between a partial-cycle bleeder brake and a full-cycle bleeder brake is that the former may permit the exhaust valve to close during most or all of the intake cycle. An example of a bleeder engine brake is disclosed in Yang, U.S. Pat. No. 6,594,996 (Jul. 22, 2003), which is hereby incorporated by reference.

The initial opening of the exhaust valves in a bleeder braking operation may be in advance of TDC of the compression stroke, and is preferably near a bottom dead center (BDC) point between the intake and compression cycles. As such, a bleeder type engine brake may require much lower force to actuate the valves, and generate less noise due to continuous bleeding instead of the rapid blow-down of a compression-release type brake. Thus, an engine bleeder brake can have significant advantages.

BRIEF SUMMARY OF THE INVENTION

In connection with an embodiment of the present invention, Applicant has developed an innovative system for providing partial bleeder braking engine valve actuation, comprising: a cam having a main exhaust lobe and a partial bleeder lobe; a rocker arm operatively connected to the cam, said rocker arm including an internal rocker passage; a valve bridge having a central portion operatively connected to the rocker arm, and having first and second ends operatively connected to first and second engine valves, respectively; a slave piston incorporated into the first end of the valve bridge; and a master piston incorporated into the central portion of the valve bridge.

In connection with another embodiment of the present invention, Applicant has developed an innovative system for providing partial bleeder braking operation in an internal combustion engine, comprising: a cam including a partial bleeder braking lobe; a valve bridge operatively connected to the cam, said valve bridge having first and second ends operatively connected to first and second engine valves, respectively; a slave piston slidably disposed in a slave piston bore incorporated into the first end of the valve bridge; a master piston incorporated into the central portion of the valve bridge; a bleed hole extending from the slave piston bore to an outer surface of the valve bridge; and a means for selectively blocking the bleed hole.

In connection with yet another embodiment of the present invention, Applicant has developed an innovative engine valve bridge adapted for lost motion engine valve actuation, said valve bridge comprising: a centrally located master piston disposed in a master piston bore; a slave piston disposed in a slave piston bore; a bridge passage extending between the master piston bore and the slave piston bore; and a bleed hole extending from the slave piston bore to an outer surface of the valve bridge.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

The present invention will now be described in connection with the following figures in which like reference characters refer to like elements and wherein.

DETAILED DESCRIPTION OF THE INVENTION

Figure 1:
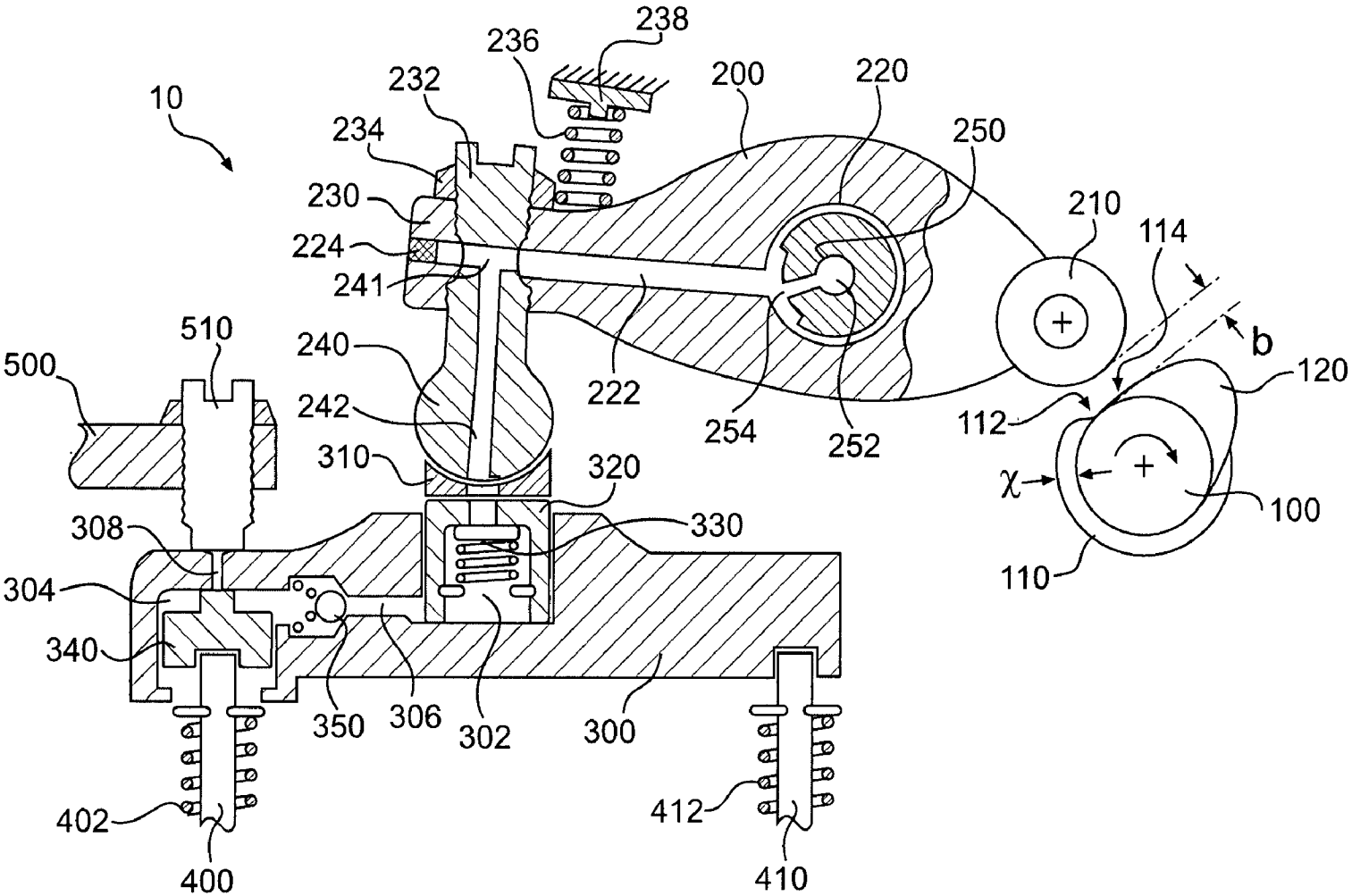
FIG. 1 a side view in partial cross-section illustrating a system for providing engine braking in accordance with a first embodiment of the present invention.

Reference will now be made in detail to a first embodiment of the present invention, an example of which is illustrated as valve actuation system 10 in FIG. 1 of the accompanying drawings. The valve actuation system 10 may include a cam 100, a rocker arm 200, a valve bridge 300, and a fixed member 500, which collectively are used to actuate the engine valves 400.

The cam 100 shown in FIG. 1 may rotate clockwise once for each set of four engine cycles. The cam 100 may include a partial bleeder braking lobe 110 and a main exhaust lobe 120. An inner base circle portion may be provided between the beginning 112 of the partial bleeder braking lobe and the end 114 of the main exhaust lobe. The partial bleeder braking lobe 110 may have a predetermined height x and the main exhaust lobe may have a height greater than x. The cam 100 is located next to, and may selectively contact, the cam roller 210 of the rocker arm 200.

The rocker arm 200 may include a central bore 220, the cam roller 210 at a first end, and an elephant foot 240 at a second end 230. A rocker passage 222 may extend from the central bore 220 to the second end 230 of the rocker arm. The rocker passage 222 may be sealed shut at its out end by a plug 224. The elephant foot 240 may incorporate an adjustment screw 232 at an upper end which may be fixed in place by a locking nut 234. The position of the elephant foot 240 relative to the rocker arm 200 may be adjusted by screwing the elephant foot into or out of the second end 230 of the rocker arm.

The central portion of the elephant foot 240 may include an annular indentation and one or more transverse passages 241 extending through the elephant foot in the region of the annular indentation. The one or more transverse passages 241 may communicate with a longitudinal passage 242 extending through the interior of the elephant foot 240 from its central portion to a lower portion. The annular indentation and the one or more transverse passages 241 in the central portion of the elephant foot may permit hydraulic fluid flow between the rocker passage 222 and the longitudinal passage 242 without regard to the orientation of the elephant foot 240 in the second end 230 of the rocker arm. As a result the elephant foot 240 may be screwed into or out of the rocker arm 200 without fear of interfering with the hydraulic communication between the rocker passage 222 and the longitudinal passage 242.

Figure 2:
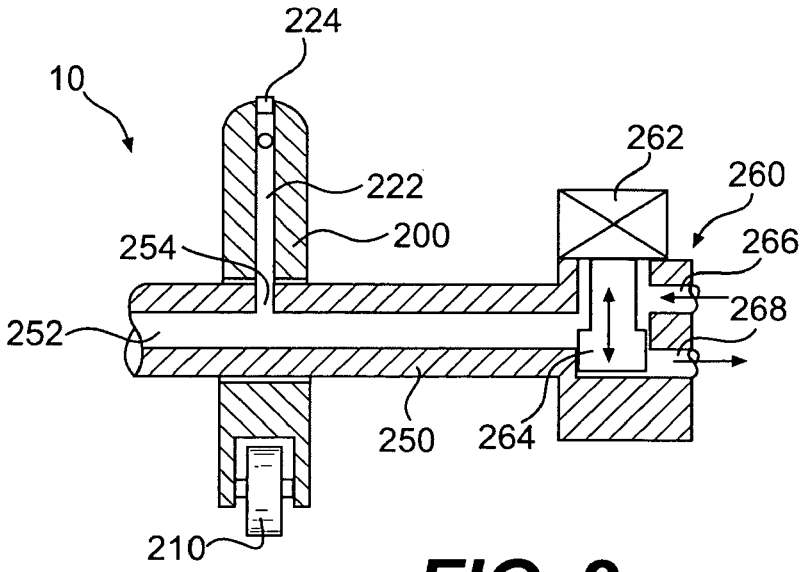
FIG. 2 is a top view in cross-section further illustrating the system shown in FIG. 1.

With reference to FIGS. 1 and 2, the rocker arm 200 may be pivotally mounted on a rocker shaft 250 extending through the central bore 220. The rocker shaft 250 may include a central supply passage 252 which may be substantially co-extensive and co-linear with the rocker shaft. A second hydraulic passage 254 may connect the supply passage 252 with the portion of the rocker passage 222 communicating with the central bore 220. The supply passage 252 may be connected to a low pressure hydraulic fluid source, such as a lube oil source (not shown), by a control valve 260. The control valve 260 may include a control piston 264 and an actuator 262, such as a solenoid. The control valve 260 may be connected to a low pressure hydraulic fluid source through a first fluid port 266 and vent hydraulic fluid through a second fluid port 268. By moving the control piston 264 up or down in its bore, the control valve 260 may selectively connect the supply passage 252 with the low pressure hydraulic fluid source through the first fluid port 266 or the vent through the second fluid port 268. As a result, the control valve 260 may be used to supply and drain hydraulic fluid to and from the supply passage 252.

With renewed reference to FIG. 1, the rocker arm 200 may be biased by a rocker spring 236 towards the valve bridge 300. The rocker spring 236 may extend between a fixed portion 238 of the engine or engine compartment and an upper portion of the rocker arm 200. The rocker spring 236 may bias the rocker arm 200 away from the cam 100 such that a lash space b is provided between the cam roller 210 of the rocker arm and the inner base circle portion of the cam 100. The height x of the partial bleeder braking lobe 110 may be substantially equal to the expanse of the lash space b.

The valve bridge 300 may be disposed between the elephant foot 240 and the engine valves 400 and 410, which are preferably exhaust valves. The engine valve springs 402 and 412 may bias the engine valves 400 and 410 upward against their seats. At the same time, the rocker spring 236 may bias the rocker arm 200 and elephant foot 240 downward into contact with the valve bridge 300 through a master piston 320. The biasing force exerted on the rocker arm 200 by the rocker spring 236 may be large enough to prevent any "no-follows" by the valve train components, but less than the force exerted on the master piston 320 by the low pressure hydraulic fluid source connected to the supply passage 252.

The master piston 320 may be slidably disposed in a master piston bore 302 located in the center of the valve bridge 300. A slave piston 340 may be slidably disposed in a slave piston bore 304 located over the first engine valve 400. A bridge passage 306 may extend through the interior of the valve bridge 300 and provide hydraulic communication between the master piston bore 302 and the slave piston bore 304. A first check valve 330 and a second check valve 350 may be disposed in the hydraulic circuit extending between the master piston 320 and the slave piston 330. A bleed hole 308 may extend from the upper end of the slave piston bore 304 to the outer surface of the valve bridge 300.

A concave member 310 may be disposed between the master piston 320 and the elephant foot 240 to assist in reducing the application of transverse loads on the master piston when the elephant foot presses down and pivots against the master piston 320 and the valve bridge 300. The concave member 310 may have an upper surface adapted to receive the rounded bottom of the elephant foot 240 and further include a central opening adapted to permit hydraulic fluid to flow through it to the master piston. The concave member 310 may permit the elephant foot 240 to maintain a fluid tight seal with, and provide hydraulic fluid to, the master piston 320 and ultimately the interior of the valve bridge 300 while the rocker arm 200 and elephant foot 240 pivot back and forth about the rocker shaft 250.

The master piston 320 may include a central passage adapted to permit hydraulic fluid to pass into the master piston bore 302 from the hydraulic passages in the concave member 310, the elephant foot 240, and the rocker arm 200. Hydraulic flow out of the master piston bore 302 may be prevented by placement of the first check valve 330 inside the master piston 320. The first check valve 330 may permit hydraulic fluid to flow into the interior of the valve bridge 300, but substantially prevent back flow of hydraulic fluid from the valve bridge to the elephant foot 240. The first check valve 330 is shown as a spring biased check disc, however, it is appreciated that any type of check valve may be used in alternative embodiments of the present invention.

The second check valve 350 may be provided in the bridge passage 306. The second check valve may permit hydraulic fluid to flow into the slave piston bore 304, but substantially prevent back flow of hydraulic fluid from the slave piston bore to the master piston bore 302. The second check valve 350 is shown as a spring biased check ball, however, it is appreciated that any type of check valve may be used in alternative embodiments of the present invention.

The slave piston 340 may include a stepped or chamfered upper surface adapted to permit hydraulic fluid to work against the slave piston upper surface. The slave piston 340 may be biased into the slave piston bore 304 by the rocker spring 236. The pressure area of the slave piston 340 is preferably greater than half of the pressure area of the master piston 320. This relationship may also be expressed as: $A_{mp}<2(A_{sp})$.

A brake load screw 510 may be held in place by a fixed member 500 otherwise connected to the engine or engine compartment. The upper surface of the valve bridge 300 in the region of the bleed hole 308 may be adapted to seat against the brake load screw 510 such that when so seated hydraulic fluid is blocked from venting through the bleed hole 308. It is appreciated that the mating surfaces of the brake load screw 510 and the valve bridge 300 may be specially finished or shaped to provide a sufficiently fluid tight seal between them. It is appreciated that other types of sealing may be used to prevent hydraulic fluid flow out of the bleed hole 308 in alternative embodiments of the present invention. The position of the brake load screw 510 may be adjusted and locked by a locking nut so that the valve bridge 300 just contacts the brake load screw when the first and second engine valves 400 and 410 are closed.

When the engine valves 400 and 410 are exhaust valves, the system 10 may be used as follows to provide (i) main exhaust valve actuation during positive power operation of the engine and (ii) partial bleeder braking valve actuation during an engine braking mode of operation. With reference to FIG. 2, during positive power operation the control piston 264 may be moved such that hydraulic fluid is free to vent from the supply passage 252 through the second fluid port 268. At the same time, fluid flow into the supply passage 252 from the first fluid port 266 is blocked by the control piston 264, and no hydraulic fluid is supplied to the rocker arm 200 or the bridge 300. Because the rocker arm 200, elephant foot 240, and bridge 300, do not contain any sufficiently pressurized hydraulic fluid, the rocker spring 236 may force the rocker arm 200, elephant foot 240, and master piston 320 downward (counter-clockwise in FIG. 1) until the master piston is at its most recessed position relative to the bridge 300. As a result, a lash space b is provided between the cam roller 210 and the cam 100 during positive power operation of the engine as shown in FIG. 1.

Rotation of the cam 100 during positive power operation results in motion being imparted to the rocker arm 200 only by the main exhaust lobe 120. Motion from the main exhaust lobe 120 pivots the rocker arm 200 about the rocker shaft 250 which forces the valve bridge 300 downward and opens both of the engine valves 400 and 410. During this process, the slave piston 340 may remain seated against the interior end wall of the slave piston bore 304 because there is no pressurized hydraulic fluid contained in the slave piston bore. Valve opening motion that could potentially be imparted to the rocker arm by the partial bleeder lobe 110 with height x during positive power operation may be "lost" as a result of the relative equivalence of the height b of the lash space between the cam roller 210 and the cam 100.

An engine braking mode of operation may be initiated by sending a control signal to the control valve 260 causing the control piston 264 to move (into a fully open position as shown in FIG. 2) and block hydraulic fluid flow through the second fluid port 268 thereby preventing further hydraulic fluid from venting from the system. At the same time, fluid flow from the fluid supply (not shown) through the first fluid port 266 into the supply passage 252 is permitted by the control piston 264. As a result, hydraulic fluid is supplied to the rocker arm 200 through the supply passage 252 and the second hydraulic passage 254.

Hydraulic fluid flows through the rocker passage 222, the transverse passage(s) 241, longitudinal passage 242, and into the interior of the valve bridge 300. Hydraulic fluid enters the valve bridge and fills the master piston bore 302, the slave piston bore 304 and the bridge passage 306. The hydraulic fluid in the valve bridge is of sufficient pressure to overcome the downward bias of the rocker spring 236 and push the master piston 320 upward. As the master piston 320 rises out of the master piston bore 302, the rocker arm 200 pivots clockwise relative to the rocker shaft 250. As the rocker arm pivots, the lash space b is taken up until the rocker arm 200 contacts the inner base circle portion of the cam 100 between the end 114 of the main exhaust lobe and the beginning 112 of the partial bleeder lobe. The supply of hydraulic fluid to the slave piston 340 may push the valve bridge 300 upward against the brake load screw.

After the rocker arm 200 contacts the inner base circle portion of the cam 100, continued rotation of the cam causes the rocker arm to begin to pivot counter-clockwise as it begins to encounter the partial bleeder lobe 110. The counter-clockwise rotation of the rocker arm 200 is opposed by the valve closing bias of the first engine valve spring 402 which acts on the rocker arm through the hydraulic fluid pressure in the circuit connecting the master piston 320 and the slave piston 340.

The partial bleeder lobe 110 may be provided on the cam 100 such that the partial bleeder event begins near the end of the intake stroke of the engine cylinder for which partial bleeder braking is desired. During the intake stroke, the pressure in the engine cylinder may be relatively low. Thus, as the partial bleeder lobe 110 pivots the rocker arm 200 counter-clockwise, the master piston 320 may displace hydraulic fluid trapped in the valve bridge and push the slave piston 340 downward to open the engine valve 400 against the bias of the valve spring 402 and the small force on the engine valve 400 by the low cylinder pressure. The partial bleeder lobe 110 may have a maximum height of x which may be constant over a majority of the duration of the lobe. The master piston 320 may be designed so that it is fully extended into and contacts the end wall of the master piston bore 302 when the rocker arm 200 is pivoted distance x by the partial bleeder lobe 110. Alternatively, or in addition, the slave piston 340 may be prevented from extending further into the engine cylinder, after the rocker arm 200 reaches its maximum displacement from the partial bleeder lobe, by including a means for stopping the slave piston, such as but not limited to a shoulder at the outer opening of the slave piston bore 304 or a similar feature incorporated into the wall of the slave piston.

No significant amount of hydraulic fluid may escape through the bleeding hole 308 during the partial bleeder event because the valve bridge 300 remains seated against the brake load screw 510 throughout it. The small opening of the engine valve 400 by the slave piston 340 may produce bleeder type engine braking. The braking load over the slave piston 340 during the compression stroke of the engine cylinder may be transferred to the brake load screw 510 through the hydraulic fluid pressure in the slave piston bore 304, which may be different than the pressure in the master piston bore 302 due to the second check valve 350. As a result, the braking load need not be transferred back through the valve train to the master piston 320, the rocker arm 200, or the cam 100. The cam 100 continues to rotate through the partial bleeder event during engine braking operation until the main exhaust lobe 120 reaches the cam roller 210 causing the rocker arm to pivot beyond the displacement produced by the partial bleeder lobe 110. The downward displacement of rocker arm 200 against the master piston 320 may no longer be hydraulically transferred to the slave piston 340 because either the master piston may be contacting the end wall of the master piston bore 302 or the slave piston 340 may be restrained by the means for stopping the slave piston. As a result, the downward displacement of the rocker arm 200 from the main exhaust lobe 120 may be transmitted mechanically from the master piston 320 to the valve bridge 300, which in turn may translate downward and open the second engine valve 410 for the main exhaust event.

The first engine valve 400 is already open when the second engine valve 410 first begins to open for the main exhaust event. As the valve bridge 300 moves downward for the main exhaust event it may pull away from the brake load screw 510 and uncover the bleed hole 308. Pressurized hydraulic fluid in the slave piston bore 304 may then escape through the bleed hole 308 and allow the slave piston 340 to move upward relative to the downward motion of the valve bridge 300 until the slave piston 340 resets against the end wall of the slave piston bore 304. The main exhaust event may then be completed by the valve bridge 300 acting on each of the engine valves 400 and 410 mechanically.

After the main exhaust lobe 120 reaches its maximum height, the rocker arm 200 pivots clock-wise until the cam roller 210 is contacting the inner base circle of the cam. As the rocker arm pivots back during the later portion of the main exhaust event, the engine valves may close against their seats and the valve bridge 300 may come to a rest. Thereafter hydraulic fluid may force the master piston 320 upward again to refill the master piston bore 302 so that the cycle of partial bleeder braking and main exhaust valve actuation is repeated as describe above.

Figure 3:
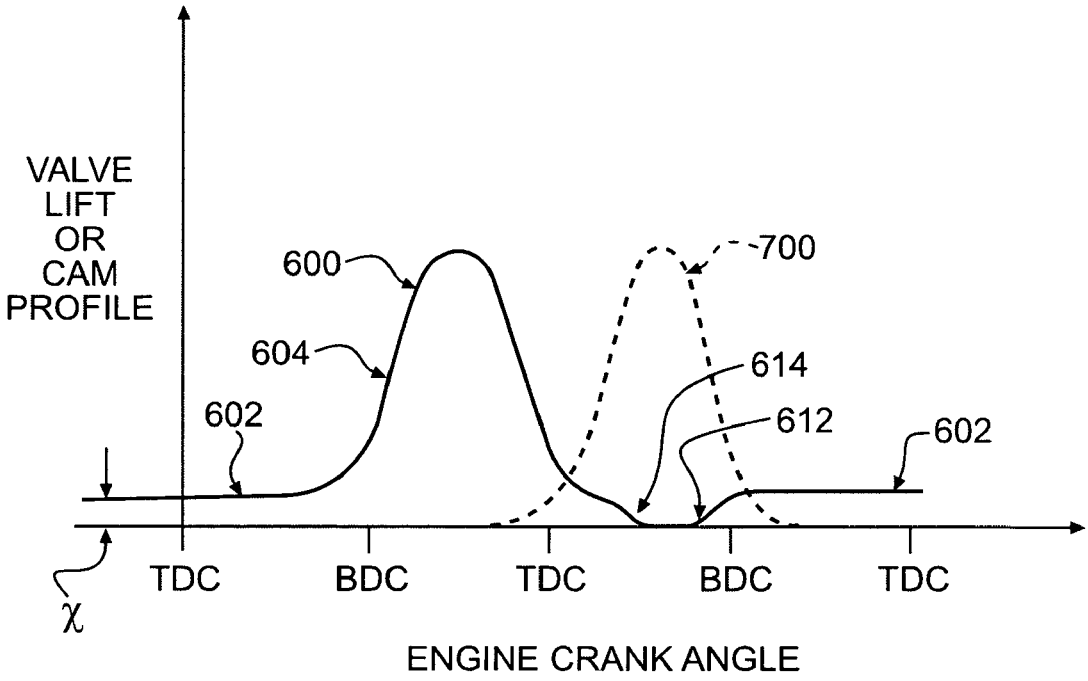
FIG. 3 is a graph illustrating an example of valve lift and cam profile versus engine crank angle position provided by the embodiment of the present invention illustrated in FIG. 1.

The cam profile and valve lift for the first engine valve 400 for the engine braking provided by the system shown in FIG. 1 is illustrated in FIG. 3. The cam may be at inner base circle and the valve at zero lift between the end 614 of the main exhaust event and the beginning of the partial bleeder event 612. This period may coincide with the occurrence of the main intake event 700. The cam may rise from its inner base circle to a relatively constant height x for the partial bleeder event 602. During the partial bleeder event, the engine valve 400 may be lifted open only slightly in accordance with the relatively small height x of the partial bleeder lobe on the cam. At the conclusion of the partial bleeder event, the cam profile and valve lift increase substantially for the main exhaust event 600. Preferably, the slave piston may reset at a point 604 during the first half of the main exhaust event.

While this invention has been described in conjunction with specific embodiments thereof, it is evident that many alternatives, modifications and variations will be apparent to those skilled in the art. For example, the shape, size and to some extent the configuration of the master and slave pistons, the cams and cam lobes, the rocker arm, the valve bridge and the control valve may be varied without departing from the intended spirit and scope of the invention. Furthermore, it is appreciated that the cam may be operatively connected to a rocker arm by directly contacting it or through any number of intervening valve train elements, including but not limited to push tubes, levers, or hydraulic systems. Still further, the use of springs in the foregoing embodiments should be considered to be illustrative of the use of any means for biasing two members towards and away from each other. Accordingly, the preferred embodiments of the invention as set forth herein are intended to be illustrative only and not limiting so long as the variations thereof come within the scope of the appended claims and their equivalents.

What is claimed is:

1. A system for providing partial bleeder braking engine valve actuation, comprising:

a cam having a main exhaust lobe and a partial bleeder lobe extending over a majority of a circumference of the cam;

a rocker arm operatively connected to the cam, said rocker arm including an internal rocker passage;

a valve bridge having a central portion positioned adjacent to the rocker arm, and having first and second ends operatively connected to first and second engine valves, respectively;

a slave piston incorporated into the first end of the valve bridge; and a master piston incorporated into the central portion of the valve bridge.

2. The system of claim 1 further comprising a means for biasing the rocker arm towards the valve bridge.

3. The system of claim 2 wherein the means for biasing the rocker arm comprises a spring.

4. The system of claim 3 further comprising:

a valve bridge passage extending between the master piston and the slave piston, said valve bridge passage hydraulically communicating with the rocker passage; and a first check valve disposed between the master piston and the slave piston.

5. The system of claim 4, further comprising a second check valve disposed between the master piston and the slave piston.

6. The system of claim 5, further comprising:

a slave piston bore provided in the first end of the valve bridge in which said slave piston is disposed;

a bleed hole extending from the slave piston bore to an outer surface of the valve bridge; and a brake load screw positioned adjacent to the bleed hole.

7. The system of claim 6, further comprising a cam inner base circle portion between the main exhaust lobe and the partial bleeder lobe.

8. The system of claim 7, further comprising an elephant foot disposed between the rocker arm and the valve bridge.

9. The system of claim 8, further comprising a master piston bore provided in the central portion of the valve bridge, said master piston bore having an end wall, wherein the master piston is slidably disposed in the mater piston bore, and wherein the master piston is selectively sized to contact the master piston end wall when the rocker arm is actuated by the main exhaust lobe.

10. The system of claim 8 further comprising a means for stopping the slave piston from extending out of the slave piston bore more than a preselected distance.

11. The system of claim 1 further comprising: a valve bridge passage extending between the master piston and the slave piston, said valve bridge passage hydraulically communicating with the rocker passage; and a first check valve disposed in the valve bridge passage between the master piston and the slave piston.

12. The system of claim 11, further comprising a second check valve disposed in the valve bridge passage between the master piston and the slave piston.

13. The system of claim 1, further comprising:

a slave piston bore provided in the first end of the valve bridge;

a bleed hole extending from the slave piston bore to an outer surface of the valve bridge; and a brake load screw adapted to selectively block the bleed hole.

14. The system of claim 1, further comprising a cam inner base circle portion between the main exhaust lobe and the partial bleeder lobe.

15. The system of claim 1, further comprising an elephant foot disposed between the rocker arm and the valve bridge.

16. The system of claim 1, further comprising a master piston bore provided in the central portion of the valve bridge, said master piston bore having an end wall, wherein the master piston is slidably disposed in the master piston bore, and wherein the master piston is selectively sized to contact the master piston end wall when the rocker arm is actuated by the main exhaust lobe.

17. The system of claim 1, further comprising a slave piston bore provided in the first end of the valve bridge, wherein the slave piston is slidably disposed in the slave piston bore, and wherein the system further comprises a means for stopping the slave piston from extending out of the slave piston bore more than a preselected distance.

18. The system of claim 1 further comprising a means for supplying hydraulic fluid to the rocker passage.

19. A system for providing partial bleeder braking operation in an internal combustion engine, comprising:

a cam including a partial bleeder braking lobe having a predetermined height over a majority of a duration of the partial bleeder braking lobe;

a valve bridge operatively connected to the cam, said valve bridge having first and second ends operatively connected to first and second engine valves, respectively;

a rocker arm operatively connecting the cam to the valve bridge;

a slave piston slidably disposed in a slave piston bore incorporated into the first end of the valve bridge;

a master piston slidably disposed in a master piston bore incorporated into the central portion of the valve bridge, the master piston fully extending and contacting an end wall of the master piston bore when the rocker arm is pivoted a distance substantially equal to the predetermined height by the partial bleeder braking lobe;

a bleed hole extending from the slave piston bore to an outer surface of the valve bridge; and a means for selectively blocking the bleed hole.

20. The system of claim 19 further comprising at least one check valve disposed in a bridge passage extending between the slave piston and the master piston.

21. The system of claim 19 wherein the means for selectively blocking the bleed hole comprises a brake load screw mounted adjacent to the outer surface of the valve bridge near the bleed hole.

22. An engine valve bridge adapted for lost motion engine valve actuation, said valve bridge comprising:

a cam including a partial bleeder braking lobe having a predetermined height over a majority of a duration of the partial bleeder braking lobe;

a centrally located master piston disposed in a master piston bore;

a slave piston disposed in a slave piston bore;

a bridge passage extending between the master piston bore and the slave piston bore; and a rocker arm operatively connecting the cam to the valve bridge, wherein when the rocker arm is pivoted a distance substantially equal to the predetermined height by the partial bleeder braking lobe, the master piston is fully extended and contacts an end wall of the master piston bore;

a bleed hole extending from the slave piston bore to an outer surface of the valve bridge.

23. The valve bridge of claim 22 further comprising at least one check valve disposed between the master piston and the slave piston.

24. The valve bridge of claim 22 further comprising a first check valve incorporated into the master piston and a second check valve disposed in the bridge passage.

* * * * *